US009076378B2

(12) United States Patent
Hwang et al.

(10) Patent No.: US 9,076,378 B2
(45) Date of Patent: Jul. 7, 2015

(54) METHOD OF DRIVING AN ELECTRO-WETTING DISPLAY PANEL AND ELECTRO-WETTING DISPLAY APPARATUS FOR PERFORMING THE SAME

(71) Applicant: Liquavista B.V., Eindhoven (NL)

(72) Inventors: Hyun-Sik Hwang, Gyeonggi-do (KR); Uk-Chul Choi, Cheonan-si (KR); Yong-Jun Jang, Yongin-si (KR); Su-Hyeong Park, Gyeongju-si (KR); Ji-Myoung Seo, Daegu (KR)

(73) Assignee: Amazon Technologies, Inc., Reno, NV (US)

( * ) Notice: Subject to any disclaimer, the term of this patent is extended or adjusted under 35 U.S.C. 154(b) by 446 days.

(21) Appl. No.: 13/649,590

(22) Filed: Oct. 11, 2012

(65) Prior Publication Data

US 2013/0113842 A1 May 9, 2013

(51) Int. Cl.
*G09G 3/20* (2006.01)
*G09G 3/34* (2006.01)

(52) U.S. Cl.
CPC ..... *G09G 3/2022* (2013.01); *G09G 3/348* (2013.01); *G09G 2300/0426* (2013.01); *G09G 2310/0251* (2013.01); *G09G 2310/027* (2013.01); *G09G 2310/0275* (2013.01); *G09G 2310/08* (2013.01); *G09G 2320/0285* (2013.01); *G09G 2320/0673* (2013.01); *G09G 2330/021* (2013.01); *G09G 2330/028* (2013.01)

(58) Field of Classification Search
CPC ..... G09G 3/348; G09G 3/2022; G09G 2300/0426; G09G 2310/0251; G09G 2310/027; G09G 2310/0275; G09G 2310/08; G09G 2320/0285; G09G 2320/0673; G09G 2330/021; G09G 2330/028; G02B 26/005; G02B 26/004; G02B 2207/115
USPC ..... 345/85, 107, 690–697; 359/290–297
See application file for complete search history.

(56) References Cited

U.S. PATENT DOCUMENTS

| | | | | |
|---|---|---|---|---|
| 2006/0200106 | A1* | 9/2006 | Okubo | 604/378 |
| 2008/0186324 | A1* | 8/2008 | Chiang | 345/589 |
| 2008/0218463 | A1* | 9/2008 | Lee et al. | 345/89 |
| 2008/0297880 | A1* | 12/2008 | Steckl et al. | 359/291 |
| 2008/0309600 | A1* | 12/2008 | Lee et al. | 345/89 |
| 2009/0027317 | A1* | 1/2009 | Cheng et al. | 345/84 |
| 2009/0027760 | A1* | 1/2009 | Wang et al. | 359/291 |
| 2010/0109987 | A1* | 5/2010 | Jessop | 345/84 |
| 2012/0169787 | A1* | 7/2012 | Chen | 345/690 |
| 2013/0127817 | A1* | 5/2013 | Hwang et al. | 345/212 |

* cited by examiner

*Primary Examiner* — Dmitriy Bolotin
(74) *Attorney, Agent, or Firm* — Lee & Hayes, PLLC

(57) ABSTRACT

A method of driving an electro wetting display panel includes applying a first data voltage to a pixel part of the display panel during a first section of a frame and applying a second data voltage different from the first data voltage to the same pixel part during a second section of the frame. The first data voltage is converted from display data based on a first gamma curve. The second data voltage is converted from the display data based on a second gamma curve. Light transmittance through the pixel part is changed based on movement of a fluid within the pixel part.

22 Claims, 10 Drawing Sheets

METHOD OF DRIVING AN ELECTRO-WETTING DISPLAY PANEL AND ELECTRO-WETTING DISPLAY APPARATUS FOR PERFORMING THE SAME

PRIORITY STATEMENT

This application claims priority under 35 U.S.C. §119 to Korean Patent Application No. KR 10-2011-0115250, filed on Nov. 7, 2011 in the Korean Intellectual Property Office (KIPO), the disclosure of which is incorporated by reference in its entirety herein.

TECHNICAL FIELD

Exemplary embodiments of the present invention relate to a method of driving an electro-wetting display panel and an electro-wetting display apparatus for performing the method of driving the electro-wetting display panel. More particularly, exemplary embodiments of the present invention relate to a method of driving an electro-wetting display panel including a fluidic layer and an electro-wetting display apparatus for performing the method of driving the electro-wetting display panel.

DISCUSSION OF RELATED ART

An electro-wetting display apparatus (EWD) includes several pixels, where an aqueous liquid and a non-aqueous liquid are disposed within each pixel. In the EWD, a voltage is applied to the aqueous liquid (for example, water) to change a surface tension of the water, and then the non-aqueous liquid (for example, oil) is moved to transmit light through the pixel.

The EWD includes an array substrate including a plurality of pixel electrodes, an opposite substrate including a common electrode facing the pixel electrodes, and water, oil and a partition wall disposed between the array substrate and the opposite substrate.

The partition wall divides a plurality of pixels, and each pixel includes the pixel electrode, the water and the oil. When the oil does not move toward the partition wall according to a voltage difference between the pixel electrode and the opposite electrode, the pixel electrode is covered by the oil. Accordingly, light provided from outside is blocked, thereby enabling the EWD to display a black state. When the surface tension of the water is changed according to the voltage difference between the pixel electrode and the opposite electrode, the oil moves toward the partition wall. Accordingly, the pixel electrode is partially uncovered by the oil to enable light provided from outside to pass through the pixel, thereby enabling the EWD to display a white state.

However, when a constant voltage is continuously applied to the pixel electrode during at least two consecutive frames, the oil tends to return to an original state, which is referred to as back-flow. A reset signal may be applied to the display panel at every frame to prevent the oil from returning.

However, since the frequency of the reset signal is relatively large, the amount of power consumed and the amount of heat generated by the EWD can be relatively large. Further, the resolution of the EWD may be rather limited.

SUMMARY

At least one exemplary embodiment of the present invention provides a method of driving an electro-wetting display panel that may reduced or prevent a first fluid from being back-flowed without increasing a data driving frequency.

At least one exemplary embodiment of the present invention also provides an electro-wetting display apparatus for performing the above-mentioned method.

According to an exemplary embodiment of the present invention, a method of driving an electro wetting display panel includes applying a first data voltage to a pixel part of the display panel during a first section of a frame and applying a second data voltage different from the first data voltage to the same pixel part during a second section of the frame. The first data voltage is converted from display data based on a first gamma curve. The second data voltage is converted from the display data based on a second gamma curve. Light transmittance through the pixel part is changed based on movement of a fluid within the pixel part.

When the first data voltage is applied during the first section of the frame, the display data may be mapped to a first look-up table based on the first gamma curve to read a first data having a first grayscale. The first data voltage may be generated using the first data. When the second data voltage is applied during the second section of the frame, the display data may be mapped to a second look-up table based on the second gamma curve to read a second data having a second grayscale. The second data voltage may be generated using the second data.

The first grayscale may be higher than the second grayscale.

In the method, a third data having a third grayscale lower than a threshold value may be generated, when the second grayscale is higher than the threshold value during each of at least two consecutive frames.

The threshold value may be a minimum of a white grayscale and medium grayscales adjacent the white grayscale.

According to an exemplary embodiment of the present invention, a method of driving an electro wetting display panel is provided. The electro-wetting display panel includes a pixel part and a fluid in the pixel that moves to control light transmittance. The method includes selecting a first mode from one of two available driving modes where each mode corresponds to a mode of driving display data, applying a first data voltage to a pixel part of the display panel during a first section of a frame, and a second data voltage different from the first data voltage to the pixel part during a second section of the frame. The first data is converted from the display data based on a first gamma curve. The second data voltage is converted from the display data based on a second gamma curve.

The method may further include selecting the second mode, applying a third data voltage to the pixel part during a first time period of a subsequent frame, maintaining a level of the third data voltage during a second time period of the subsequent frame, and applying a reset voltage to the pixel part during a third time period of the subsequent frame. The third data voltage may be converted from the display data. The reset voltage may be converted from reset data.

The first mode may be driven at a driving frequency substantially the same as or greater than about 60 Hz, and the second mode may be driven with a driving frequency less than about 60 Hz.

According to an exemplary embodiment of the present invention, an electro wetting display apparatus includes an electro-wetting display panel and a driving part. The electro-wetting display panel displays an image, and includes a first substrate including a plurality of pixel electrodes, a second substrate including a common electrode facing the pixel electrode and a fluidic layer disposed between the first substrate and the second substrate. The fluidic layer changes light transmittance. The driving part provides a first data voltage to the electro-wetting display panel during a first section of a frame and a second data voltage to the electro-wetting display panel during a second section of the frame. The first data is converted from a display data of the image based on a first gamma curve. The second data is converted from the display data based on a second gamma curve. The second data voltage is different from the first data voltage.

The first substrate may include a plurality of notch electrodes respectively corresponding to the pixel electrodes, respectively.

The fluidic layer may include a first fluid and a second fluid. The first fluid corresponds to the pixel electrode and the notch electrode, and the first fluid may be hydrophobic. The second fluid corresponds to the common electrode, and the second fluid may be hydrophilic. The first fluid may move toward the notch electrode due to a voltage difference between the pixel electrode and the common electrode.

The driving part may include a timing controlling part, a gamma voltage generating part and a data driver. The timing controlling part may include a grayscale correcting part mapping the display data to a first look-up table based on the first gamma curve to read a first data having a first grayscale during the first section and mapping the display data to a second look-up table based on the second gamma curve to read a second data having a second grayscale during the second section. The gamma voltage generating part may generate a reference gamma voltage according to the display data. The data driver may generate the first data voltage using the first data and the reference gamma voltage, and generate the second data voltage using the second data and the reference gamma voltage.

The first grayscale may be higher than the second grayscale.

The timing controlling part may further include a white grayscale correcting part generating a third data having a third grayscale lower than a threshold value during each of at lease two consecutive frames, when the first grayscale is higher than the threshold.

The threshold value may be a minimum of a white grayscale and medium grayscales adjacent the white grayscale.

According to an exemplary embodiment of the present invention, an electro wetting display apparatus includes an electro-wetting display panel and a driving part. The electro-wetting display panel displays an image, and includes a first substrate including a plurality of pixel electrodes, a second substrate including a common electrode facing the pixel electrodes and a fluidic layer disposed between the first substrate and the second substrate. The fluidic layer changes light transmittance. The driving part drives a display data of the image in a first mode or a second mode. The driving part, in the first mode, provides a first data voltage converted from the display data based on a first gamma curve and a second data voltage converted from the display data based on a second gamma curve to the electro-wetting display panel during a frame. The second data voltage is different from the first data voltage. The driving part, in the second mode, provides a third data voltage converted from the display data and a reset voltage converted from a reset data to the electro-wetting display panel during the frame.

The driving part may include a timing controlling part driving the display data in the first mode based on a first control signal or the second mode based on a second control signal. The timing controlling part may include a first mode controlling part and a second mode controlling part. The first mode controlling part may map the display data to a first look-up table based on the first gamma curve to read a first data having a first grayscale during a first section of the frame and map the display data to a second look-up table based on the second gamma curve to read a second data having a second grayscale during a second section of the frame in a first mode. The second mode controlling part may output the display data during a first time of the frame, provide a maintain signal constantly maintaining a third data voltage according to the display data during a second time of the frame, and provide a reset data during a third time of the frame in the second mode.

The driving part may further include a gamma voltage generating part and a source driver. The gamma voltage generating part may generate a reference gamma voltage according to the display data. The source driver may generate the first data voltage using the first data and the reference gamma voltage, the second data voltage using the second data and the reference gamma voltage, the third data voltage using the display data and the reference gamma voltage and a reset voltage using a reset data and the reference gamma voltage.

The first mode may be driven at substantially the same as or more than about 60 Hz, and the second mode may be driven at less than about 60 Hz.

The reset data may have a black grayscale.

In an exemplary embodiment of the invention, even when a same display data is displayed during at least two consecutive frames, a first fluid may be prevented from being backflowed by a low grayscale of the display data provided during a frame and by a high grayscale of the display data provided during a next frame. Thus, a brightness of a display panel may be prevented from being reduced.

In an exemplary embodiment of the invention, the electro-wetting display apparatus is driven with a high frequency by a first mode controlling part or is driven with a low frequency by a second mode controlling part, so that power consumption and an amount of heat generated may decrease.

According to an exemplary embodiment of the invention, a method of driving an electro-wetting display panel includes generating a first grayscale that is higher than display data for the display panel, generating a second grayscale that is lower than the display data, applying a first data voltage based on the first gray scale to a pixel part of the display panel during a first section of a frame, and applying a second data voltage based on the second grayscale to the same pixel part during a second section of the frame.

The pixel part includes a fluid whose movement is adjusted by the applied voltages to change transmittance of light through the pixel part. The second grayscale may be lower than a half-brightness grayscale of the display panel.

BRIEF DESCRIPTION OF THE DRAWINGS

The present invention will become more apparent by describing detailed exemplary embodiments thereof with reference to the accompanying drawings, in which.

DETAILED DESCRIPTION

Hereinafter, exemplary embodiments of the present invention will be explained in detail with reference to the accompanying drawings. However, the present invention may be embodied in various different ways and should not be construed as limited to the exemplary embodiments described herein.

As used herein, the singular forms, "a," "an" and "the" are intended to include the plural forms as well, unless the context clearly indicates otherwise.

Figure 1:
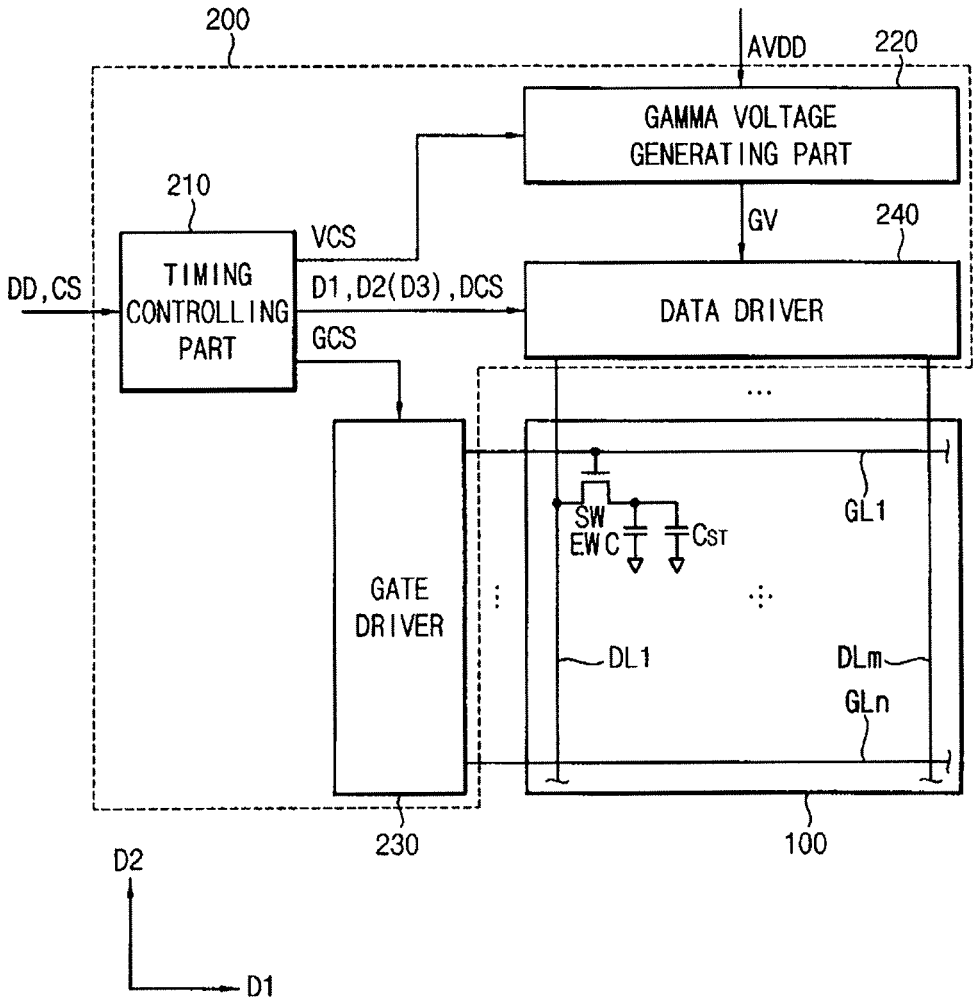
FIG. 1 is a block diagram illustrating an electro-wetting display apparatus according to an exemplary embodiment of the present invention.
Figure 2:
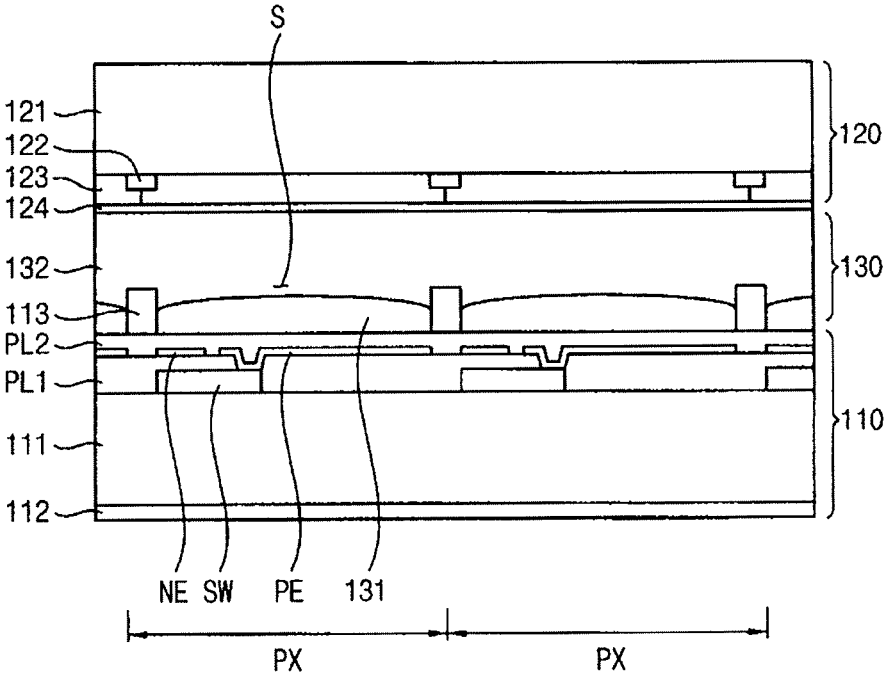
FIG. 2 is a cross-sectional view illustrating an electro-wetting display panel of FIG. 1 according to an exemplary embodiment of the present invention.

FIG. 1 is a block diagram illustrating an electro-wetting display apparatus according to an exemplary embodiment of the present invention. FIG. 2 is a cross-sectional view illustrating an electro-wetting display panel of FIG. 1 according to an exemplary embodiment of the present invention.

Referring to FIG. 1 and FIG. 2, an electro-wetting display apparatus according to an exemplary embodiment includes an electro-wetting display panel (hereinafter, a display panel) 100 and a driving part 200.

The display panel 100 is driven by the driving part 200 to display an image according to a transmittance of light. The display panel 100 includes a first substrate 110, a second substrate 120 facing the first substrate 110, and a fluidic layer 130 disposed between the first substrate 110 and the second substrate 120.

The first substrate 110 includes a first base substrate 111, a plurality of pixel parts PX disposed on a first surface of the first base substrate 111 and a reflecting plate 112 disposed on a second surface of the first base substrate 111. The pixel part PX includes a gate line GL, a data line DL, a switching element SW, a first passivation layer PL1, a pixel electrode PE, a notch electrode NE, a second passivation layer PL2 and a partition wall 113.

The gate line GL extends in a first direction D1, and the data line DL extends in a second direction D2 crossing the first direction D1. The switching element SW is electrically connected to the gate line GL and the data line DL.

The first passivation layer PL1 is disposed on the switching element SW. The pixel electrode PE is disposed on the first passivation layer PL1. The pixel electrode PE is electrically connected to the switching element SW through a contact hole of the first passivation layer PL1 partially exposing the switching element SW. A data voltage provided from the data line DL may be applied to the pixel electrode PE.

The notch electrode NE is disposed on the first passivation layer PL1 and adjacent the pixel electrode PE. A voltage applied to notch electrode may be the same as a voltage applied to the common electrode 124 of the second substrate 120.

The second passivation layer PL2 is disposed on the pixel electrode PE and the notch electrode NE. In an embodiment, the second passivation layer PL2 is hydrophobic (e.g., includes hydrophobic molecules). Hydrophobic molecules tend to be non-polar and, thus prefer other neutral molecules and non-polar solvents. Examples of hydrophobic molecules include alkanes, oils, fats, etc.

The partition wall 113 is disposed on the second passivation layer PL2. The partition wall 113 is disposed along an edge of the pixel part PX to form a receiving space S.

The reflecting plate 112 reflects light passing through the second substrate 120, the fluidic layer 130 and the first substrate 110 toward the second substrate 120.

The second substrate 120 includes a second base substrate 121 and a plurality of color parts. A corresponding one of the color parts is disposed on the second base substrate 121 and overlaps with a corresponding one of the pixel parts PX. The color part includes a light blocking pattern 122, a color filter 123 and a common electrode 124.

The light blocking pattern 122 is disposed on the second base substrate 121 and overlaps with the partition wall 113. For example, the light blocking pattern 122 may overlap with the second base substrate 121 in the second direction d2.

The color filter 123 is disposed on the first base substrate 121 and between the light blocking patterns 122 adjacent each other. The common electrode 124 is disposed on the color filter pattern 123. The common electrode 124 faces the pixel electrode PE and the notch electrode NE.

The fluidic layer 130 includes a first fluid 131 which is hydrophobic and a second fluid 132 which is hydrophilic (e.g., includes hydrophilic molecules). A hydrophilic molecule is one that has a tendency to interact with or be dissolved by water and other polar substances.

The first fluid 131 is disposed in the receiving space S formed by the partition wall 113. For example the first fluid 131 may be black oil.

The remaining space except for the space filled with the first fluid 131 between the first substrate 110 and the second substrate 120 is filled with the second fluid 132.

The pixel electrode PE, the common electrode 124 and the fluidic layer 130 between the pixel electrode PE and the common electrode 124 may form an electro-wetting capacitor EWC.

As shown in FIG. 2, when no voltage difference is present between the common electrode 124 and the pixel electrode PE, the first fluid 131 is broadly spread in the receiving space S, so that the first fluid 131 covers the pixel electrode PE and the notch electrode NE. Thus, the light passing through the second substrate 120 is blocked by the first fluid 131, so that the pixel PX displays a black grayscale.

Figure 3A:
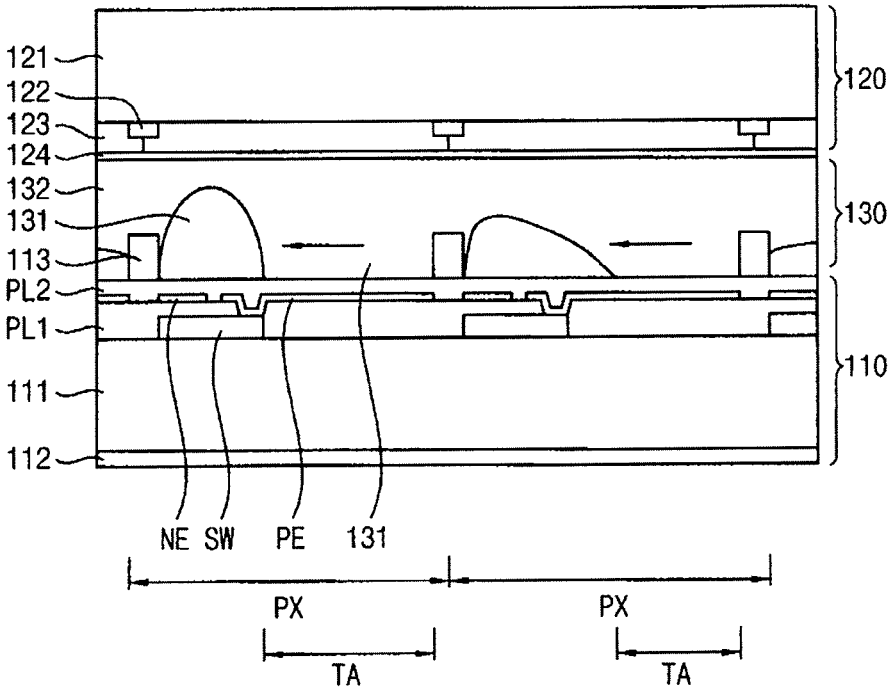
FIG. 3A is a cross-sectional view illustrating the electro-wetting display panel with a voltage difference between a common electrode and a pixel electrode.

FIG. 3A is a cross-sectional view illustrating the electro-wetting display panel with a voltage difference between a common electrode and a pixel electrode.

Referring to FIG. 3A, when a voltage difference is present between the common electrode 124 and the pixel electrode PE, and a voltage the same as one applied to the common electrode 124 is applied to the notch electrode NE, the first fluid 131 moves toward the notch electrode NE. The movement of the first fluid 131 toward the notch electrode NE generates a transmitting area TA in which light is transmitted.

Thus, light passing through the second substrate 120 passes through the first substrate 110, is reflected by the reflecting plate 112, and is provided to the second substrate 120.

As the absolute value of the voltage difference between the common electrode 124 and the pixel electrode PE increases, the first fluid 131 moves closer toward the notch electrode NE and the size (e.g., width) of the transmitting area TA increases. For example, as the voltage difference increases, the right-most edge of the volume of the first fluid 131 moves closer and closer to the notch electrode NE. Thus, the pixel part PX may display a white grayscale and medium grayscales adjacent the white grayscale (e.g., grayscales of 128-255). As an absolute value of the voltage difference between the common electrode 124 and the pixel electrode PE decreases, the first fluid 131 is driven less and less towards the notch electrode NE and then the size (e.g., width) of the transmitting area TA decreases. For example, as the voltage difference decreases, the right-most edge of the volume of the first fluid 131 moves further and further away from the notch electrode NE. Thus, the pixel part PX may display various grayscales such as black, and grayscales between black and a medium gray.

Figure 3B:
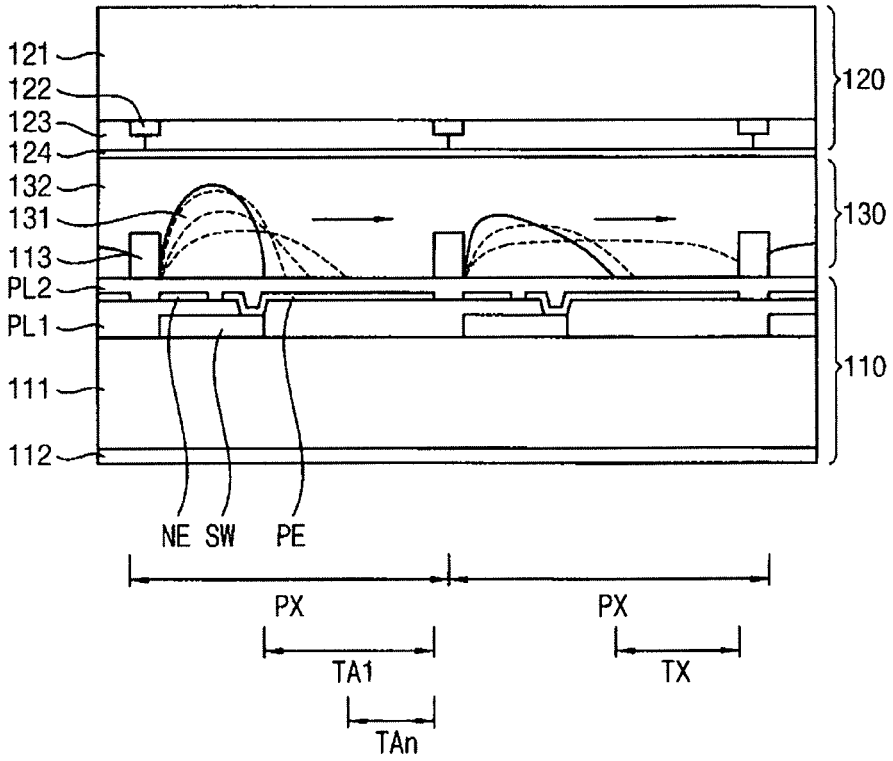
FIG. 3B is a cross-sectional view illustrating the electro-wetting display panel with no voltage difference between a common electrode and a pixel electrode during consecutive frames.

FIG. 3B is a cross-sectional view illustrating the electro-wetting display panel with no voltage difference between a common electrode and a pixel electrode during consecutive frames.

Referring to FIG. 3B, when voltage differences between the common electrode 124 and the pixel electrode PE in the pixel part PX are the same for several consecutive periods (e.g., from a first frame to an n-th frame), areas of transmitting areas TA formed by the first fluid 131 are substantially the same during the first to n-th frames (here, 'n' is a natural number greater than or equal to 2).

However, when voltage differences between the common electrode 124 and the pixel electrode PE in the pixel part PX are the same during the first frame to the n-th frame, a back-flow of the first fluid 131 may occur that decreases the transmitting area TA.

For example, during the first frame, the first fluid 131 moves toward the notch electrode NE according to the voltage difference between the common electrode 124 and the pixel electrode PE to form a first transmitting are TA1 having a first area. During the n-th frame, the first fluid 131 does not form the first transmitting area TA1 having the first area according to the voltage difference, but forms a second transmitting area TA2 having a second area smaller than the first area as the first fluid 131 back-flows. Thus, the pixel part PX displays a grayscale lower than the originally intended grayscale during the n-th frame, so that the brightness of the pixel part PX decreases.

Hereinafter, a driving part 200 according to an exemplary embodiment of the invention is described that may be used to prevent the first fluid 131 from back-flowing.

Referring to FIG. 1, the driving part 200 includes a timing controlling part 210, a gamma voltage generating part 220, a gate driver 230 and a data driver 240.

Figure 4:
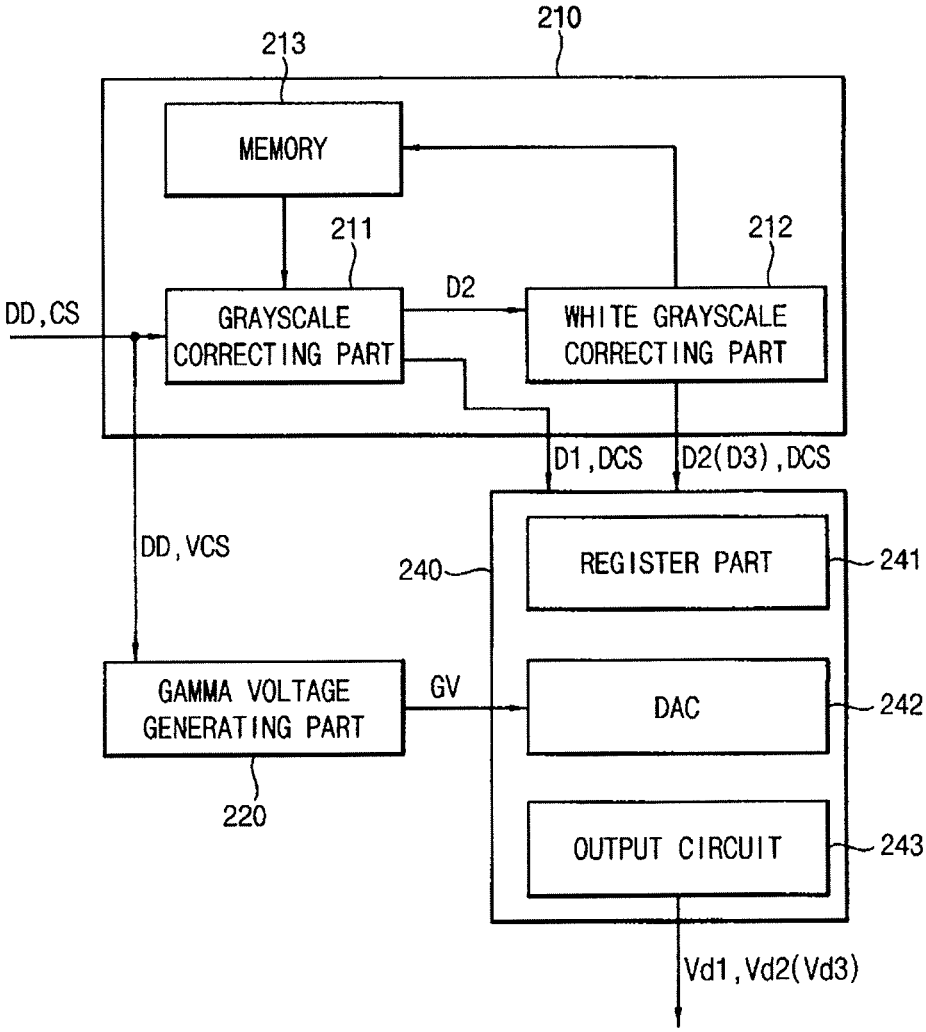
FIG. 4 is a block diagram illustrating a timing control part, a gamma voltage generating part and a source driver of FIG. 1 according to an exemplary embodiment of the present invention.

FIG. 4 is a block diagram illustrating a timing controlling part 210, a gamma voltage generating part 220 and a data driver 240 (e.g., a source driver) of FIG. 1.

Referring to FIG. 4, the timing controlling part 210 receives display data DD and a control signal CS from an external source. The timing controlling part 210 generates a gamma controlling signal VCS, a gate controlling signal GCS and a data controlling signal DCS which are provided to the gamma voltage generating part 220, a gate driver 230 and a data driver 240, respectively.

The timing controlling part 210 includes a grayscale correcting part 211, a white grayscale correcting part 212 and a memory 213.

In an embodiment, the grayscale correcting part 211 corrects a display grayscale of the display data DD twice during a single frame, and generates a first data D1 having a high grayscale higher than the display grayscale and a second data D2 having a low grayscale lower than the display grayscale.

For example, when the display data DD has a 126-grayscale, the grayscale correcting part 211 maps the 126-grayscale with a look-up table to read the first data D1 having a 144-grayscale (e.g., the high grayscale) during a first section of the frame, and the grayscale correcting part 211 maps the 126-grayscale with the look-up table to read the second data D2 having a 108-grayscale (e.g., the low grayscale) during a second section of the frame. In this example, the two values read from the table are 18 grayscale units away from the display data DD. However, embodiments of the invention are not limited thereto. For example, the two values may be greater or less than 18 grayscale units away from the display data DD (e.g., 16, 17, 20, etc.), and may also be different from each other (e.g., 16 and 17, 18 and 20, etc.).

The grayscale difference between the high grayscale and the low grayscale is chosen to reduce or prevent the first fluid 131 from back-flowing. The grayscale difference may be changed according to a specification of the electro-wetting display apparatus.

However, when the display data DD ranges between a white grayscale (e.g., a 256 grayscale) and medium grayscales adjacent the white grayscale (e.g., 128-255) (hereinafter referred to as lighter grayscales), the grayscale difference between the high grayscale and the low grayscale for each of the lighter grayscales may be insufficient to prevent the first fluid 131 from back-flowing. Thus, even though the display data DD is corrected by the grayscale correcting part 211, the first fluid 131 according to the lighter grayscales may back-flow during at least two consecutive frames.

In an embodiment of the invention, the white grayscale correcting part 212 can be used to reduce or prevent the first fluid 131 from back-flowing when the display data DD is set to the lighter grayscales. In an alternate embodiment, the white grayscale correcting part 212 is omitted.

The white grayscale correcting part 212 maps the low grayscale to the look-up table to read a third data D3 having a lower grayscale lower than a threshold value, when the low grayscale of the display data DD is larger than the threshold value during each of at least two consecutive frames. Thus, a grayscale difference between the high grayscale of the display data DD and the lower grayscale of the display data DD may be chosen to reduce or prevent the first fluid 131 from back-flowing.

In an embodiment, the threshold value is preset to be a minimum of the low grayscales of the lighter grayscales. For example, if the lighter grayscales range from 128-255, the threshold value could be set to 128, and the third data D3 is set to a value (e.g., 110, 120, etc.) less than a half-brightness (e.g., 127, 128, etc.) of the display panel. However, the range of lighter grayscales and the threshold value are not limited thereto. For example, the lighter grayscales could range between 127-255, 126-255, etc., and thus the threshold value could be 126, 127, etc. Further, while the range of displayable grayscales has been described as ranging between 0-255, embodiments of the present invention are not limited thereto.

In alternate embodiments, the range of displayable grayscales can vary considerably (e.g., 0-64, 0-128, 0-512, etc.).

In an embodiment, the timing controlling part 210 provides the first data D1 to the display panel 100 during a first section of a frame, and provides the second data D2 to the display panel 100 during a second section of the frame, so that the display panel 100 displays the display data DD during the frame. The timing controlling part 210 may drive the display panel 100 with one of various driving frequencies (e.g., 60 Hz, 120 Hz, etc.).

In an embodiment, the gamma voltage generating part 220 receives a driving voltage AVDD from an external source, and receives the display data DD and the gamma controlling signal VCS from the timing controlling part 210. In an embodiment, the gamma voltage generating part 220 generates reference gamma voltages GV based on the driving voltage AVDD and the gamma control signal VCS, and provides the reference gamma voltages GV to the data driver 240. In an embodiment, the gamma voltage generating part 220 generates reference gamma voltages GV based on the driving voltage AVDD, the display data DD, and the gamma control signal VCS.

The gate driver 230 receives the gate control signal GCS from the timing controlling part 210. The gate driver 230 provides a gate-on signal to a corresponding one of the gate lines GL based on the gate control signal GCS.

The data driver 240 receives the first and second data D1 and D2 or the first and third data D1 and D3 and the data control signal DCS from the timing control part 210, and receives the reference gamma voltages GV from the gamma voltage generating part 220.

In an embodiment, the data driver 240 includes a register part 241, a digital-to-analog converter (DAC) 242 and an output circuit 243.

The register part 241 provides the first data D1 corresponding to a gate line GL to the DAC 242 based on the data control signal DCS during the first section of the frame. In addition, the register part 241 provides one of the second data D1 and the third data D3 corresponding to the gate line GL to the DAC 242 based on the data control signal DCS during the second section of the frame.

The DAC 242 receives the first data D1 from the register part 241 during the first section of the frame, and receives the reference gamma voltages GV from the gamma voltage generating part 220. The DAC 242 generates a first data voltage Vd1 based on the first data D1 and the reference gamma voltages GV during the first section of the frame.

The DAC 242 receives one of the second data D2 and the third data D3 from the register part 241 during the second section of the frame, and receives the reference gamma voltages GV from the gamma voltage generating part 220. The DAC 242 generates one of a second data voltage Vd2 and a third data voltage Vd3 based on the reference gamma voltages GV and one of the second data D2 and the third data D3.

The output circuit 243 receives one of the first data voltage Vd1 to the third data voltage Vd3 from the DAC 242, and provides one of the first data voltage Vd1 to the third data voltage Vd3 to the data line DL. In an embodiment, the output circuit 243 amplifies the received data voltage, and provides the amplified data voltage to the data line DL.

The display panel 100 displays a first brightness according to the first data voltage Vd1 during the first section of the frame, and displays one of a second brightness and a third brightness according to the second data voltage Vd2 and the third data voltage Vd3 during the second section of the frame. Thus, the display panel 100 may display an optimal brightness according to the data voltage based on the display data DD and the reference gamma voltage GV during a single frame. For example, the display panel 100 may display the optimal brightness which is the sum of the first brightness and one of the second brightness and the third brightness during the frame.

Thus, even when the same display data DD is continuously provided to the display panel 100 during consecutive frames, the second brightness according to the low grayscale of the display data DD is displayed during the second section of a frame, and the first brightness according to the high grayscale of the display data DD is displayed during the first section of a next frame. As a result, data different from each other may be continuously provided to the display panel 100 during the consecutive frames, so that back-flowing of the first fluid 131 may be reduced or prevented during the consecutive frames.

Figure 5:
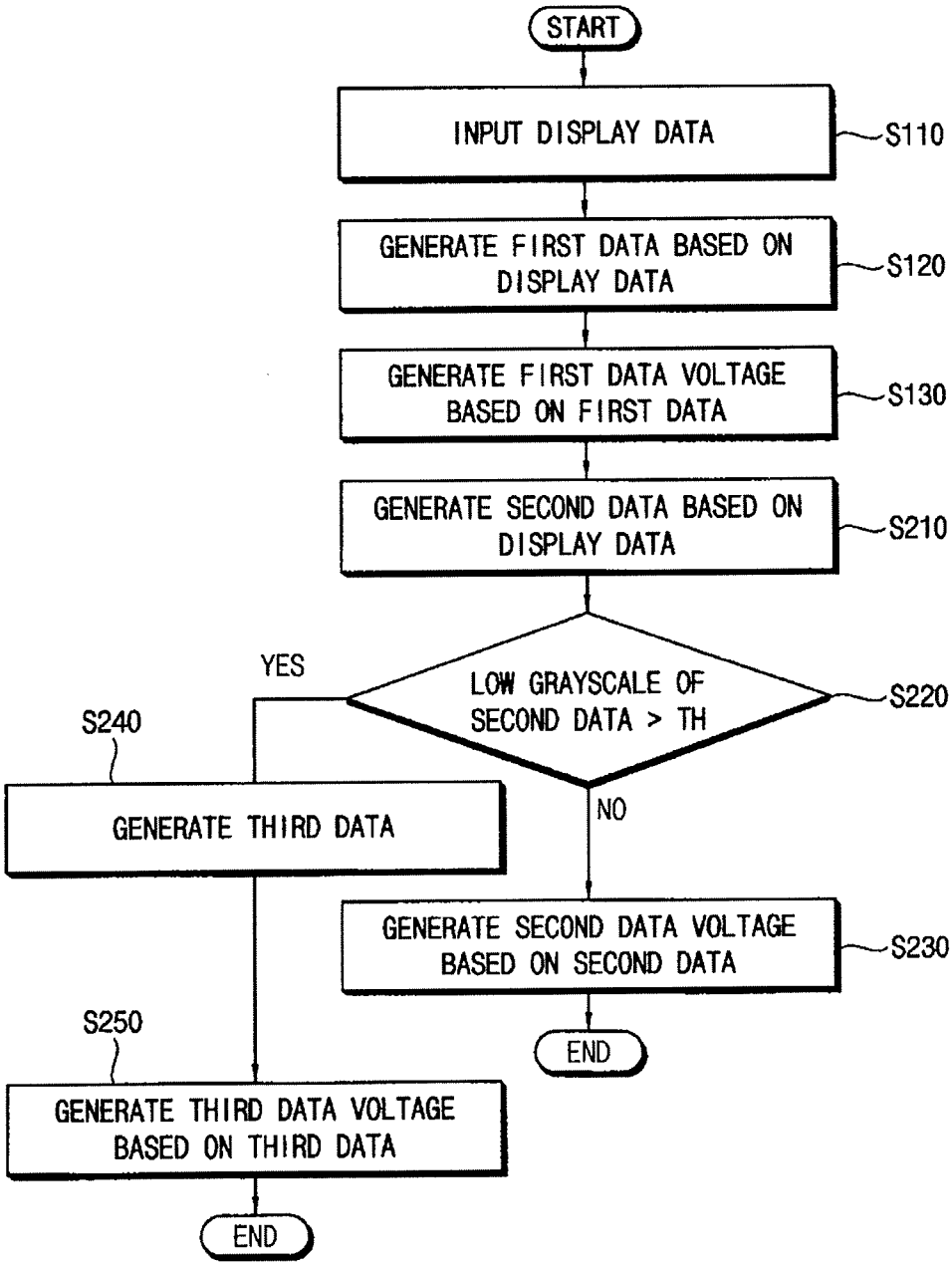
FIG. 5 is a flow chart illustrating a method of driving the electro-wetting display panel of FIG. 1 according to an exemplary embodiment of the present invention.
Figure 6:
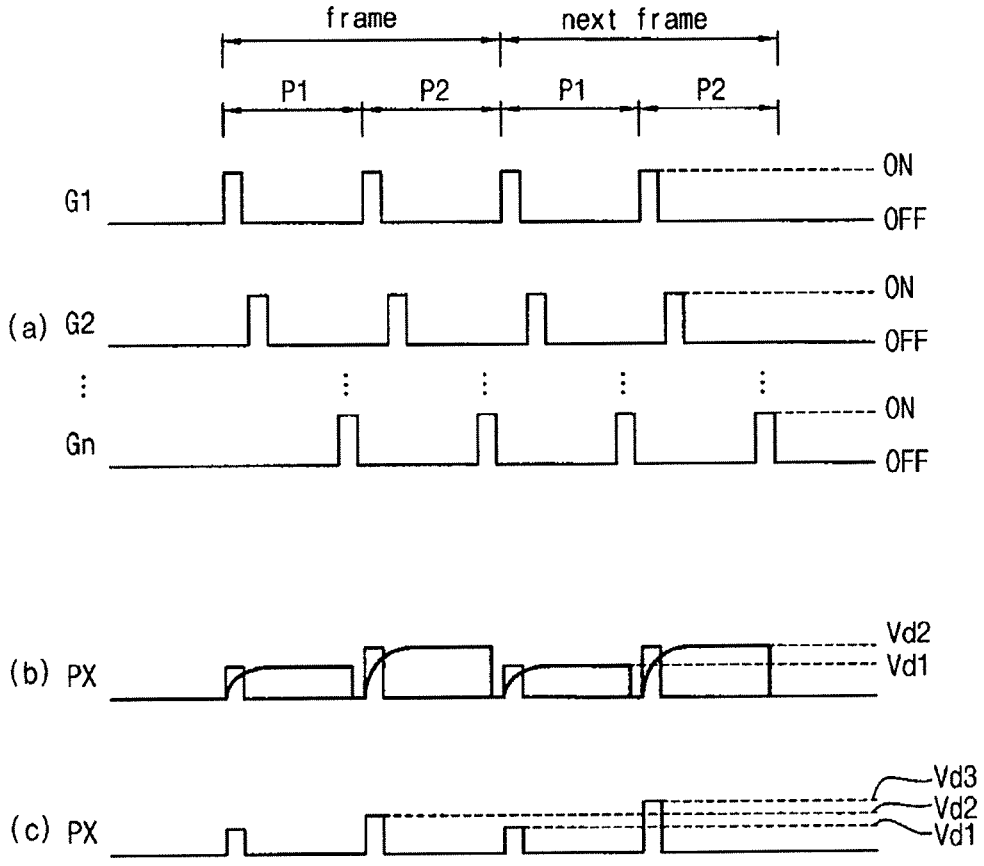
FIG. 6 includes timing diagrams illustrating exemplary electrical signals of FIG. 5.

FIG. 5 is a flow chart illustrating a method of driving the electro-wetting display panel of FIG. 1 according to an exemplary embodiment of the invention. FIG. 6 includes timing diagrams illustrating exemplary electrical signals of FIG. 5.

Referring to FIG. 4 to FIG. 6, the timing controlling part 210 receives the display data DD and a control signal CS from an external source, and generates a gamma control signal VCS, a gate control signal GCS and a data control signal DCS based on the control signal CS.

The display data DD, the gate control signal GCS and the data control signal DCS are provided (input) to the grayscale correcting part 211 (step S110).

The gray scale correcting part 211 of the timing controlling part 211 generates first data D1 having a level higher than a display grayscale of the display data DD (step S120). In an embodiment, the grayscale correcting part 211 maps the display grayscale to a first look-up table based on a first gamma curve to generate the first data D1 having a level higher than the display grayscale during a first section P1 of the frame of the display data DD. The grayscale correcting part 211 may then provide the first data D1 and the data control signal DCS to the data driver 240, the gamma control signal VCS to the gamma voltage generating part 220, and the gate control signal GCS to the gate driver 230.

In an embodiment, the gate driver 230 sequentially provides a gate-on signal ON based on the gate control signal GCS to the first to n-th gate lines G1, . . . , Gn, during the first section P1 of the frame. The data driver 240 generates a first data voltage Vd1 corresponding to the high grayscale using the first data D1 and reference gamma voltages GV generated from the gamma voltage generating part 220 based on the data control signal DCS (step S130). In an embodiment, the data driver 240 provides the first data voltage Vd1 to the display panel 100 during the first section P1 of the frame.

Referring to FIG. 6 and reference numeral (a), the first gate line G1 to the n-th gate line Gn are sequentially activated (e.g., turned on) according to the gate-on signal ON during the first section P1 of the frame. Referring to FIG. 6 and reference numeral (b), the first data voltage Vd1 is provided to a pixel PX electrically connected to the first gate line G1, and the pixel PX is charged with the first data voltage Vd1.

The grayscale correcting part 211 of the timing controlling part 210 generates second data D2 having a level lower than a display grayscale of the display data DD (step S210). In an embodiment, the grayscale correcting part 211 maps the display grayscale to a second look-up table based on a second gamma curve to read the second data D2 having a grayscale lower than the display grayscale during the second section P2 of the frame of the display data DD. The grayscale correcting part 211 may then provide the second data D2 to the white grayscale correcting part 212 of the timing controlling part 210, and provide the gate control signal GCS to the gate driver 230.

The white grayscale correcting part 212 compares the low grayscale of the second data D2 with a preset threshold value TH (step S220).

When the low grayscale of the second data D2 is smaller than or substantially the same as the threshold value TH, a second data voltage Vd2 is generated from the second data D2 (S230). For example, the second data D2 and the data control signal DCS are provided to the data driver 240, and the gamma control signal VCS is provided to the gamma voltage generating part 220.

Then the gate driver 230 sequentially provides the gate-on signal ON based on the gate control signal GCS to the first gate line G1 to the n-th gate line Gn during the second section P2 of the frame, and the data driver 240 generates the second data voltage Vd2 corresponding to the low grayscale based on the second data D2 and the reference gamma voltages GV to provide the second data voltage Vd2 to the display panel 100 during the second section P2 of the frame.

Referring to FIG. 6 and reference numeral (a), the first gate line G1 to the n-th gate line Gn are sequentially activated (e.g., turned on) according to the gate-on signal ON during the second section P2 of the frame. For example, referring to FIG. 6 and reference numeral (b), the second data voltage Vd2 is provided to the pixel PX electrically connected to the first gate line G1, and the pixel PX is charged with the second data voltage Vd2.

When the low grayscale of the second data D2 is larger than the threshold value TH, third data D3 is generated (S240). For example, the white grayscale correcting part 212 may map the low grayscale of the second data D2 to a third look-up table to read third data D3 having a lower grayscale lower than the low grayscale. The white grayscale correcting part 212 provides the third data D3 and the data control signal DCS to the data driver 240, and provides the gamma control signal VCS to the gamma voltage generating part 220.

The data driver 240 generates the third data voltage Vd3 based on the third data D3 and the reference gamma voltage GV (S250). The data driver 240 may then provide the third data voltage Vd3 to the display panel 100.

Referring to FIG. 6 and reference numeral (c), the third data voltage Vd3 is provided to a pixel electrically connected to the first gate line G1, and the pixel PX is charged with the third data voltage Vd1 during a second section P2 of a next frame.

Thus, the display panel 100 may display an optimal brightness of the display data DD that corresponds to a sum of a first brightness according to the first data voltage VD1 and a second brightness according to the second data voltage VD2 or the third data voltage VD3 during the next frame.

In an exemplary embodiment, the first data voltage Vd1 corresponding to the high grayscale is provided during the first section P1 of the frame, and the second data voltage Vd2 corresponding to the low grayscale is provided during the second section P2 of the frame, and vice versa.

Figure 7:
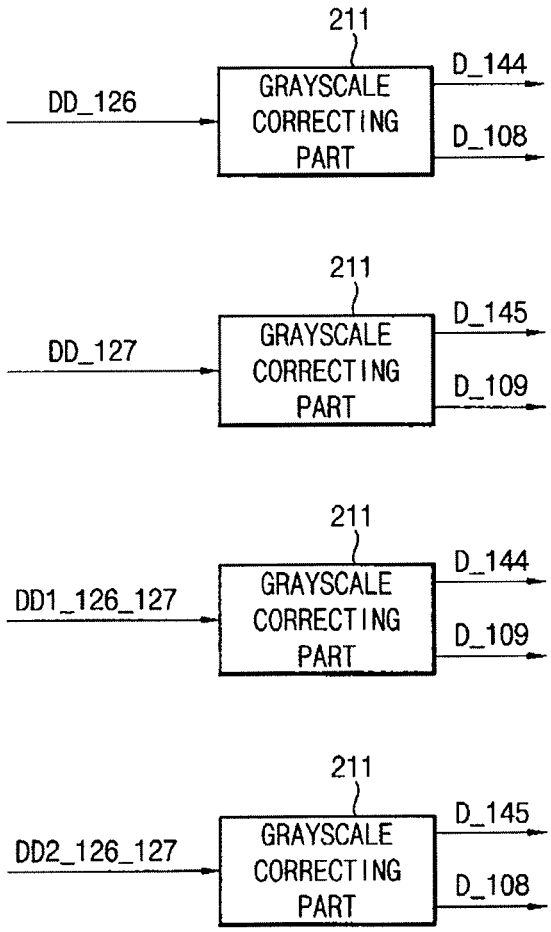
FIG. 7 is a block diagram illustrating a method of increasing a grayscale.

FIG. 7 is a block diagram illustrating a method of increasing a grayscale according to an exemplary embodiment of the invention.

Referring to FIG. 7, the grayscale correcting part 211 of the timing controlling part 210 receives a display data DD_126 having a 126 grayscale during a frame. The grayscale correcting part 211 may map the display data DD_126 to the look-up table LU provided from the memory 213 to read a first data D_144, which is a high grayscale having a 144 grayscale during the first section of the frame. The grayscale correcting part 211 may map the display data DD_126 to the look-up table LU provided from the memory 213 to read a second data D_108, which is a low grayscale having a 108 grayscale during the second section of the frame.

Thus, the data driver 240 provides data voltages generated based on the reference gamma voltages GV and each of the first data D_144 having the 144 grayscale and the second data D_108 having the 108 grayscale. Accordingly, the display panel 100 may display a brightness corresponding to the 126 grayscale based on the data voltages during the frame.

In another example, the grayscale correcting part 211 receives a display data DD_127 having a 127 grayscale during a frame. The grayscale correcting part 211 may map the display data DD_127 to the look-up table LU provided from the memory 213 to read a first data D_145 which is a high grayscale having a 145 grayscale during the first section of the frame. The grayscale correcting part 211 may map the display data DD_127 to the look-up table LU provided from the memory 213 to read a second data D_109 which is a low grayscale having a 109 grayscale during the second section of the frame.

Thus, the data driver 240 provides data voltages generated based on the reference gamma voltages GV and each of the first data D_145 having the 145 grayscale and the second data D_109 having the 109 grayscale to the display panel 100. Accordingly, the display panel 100 may display a brightness corresponding to the 127 grayscale based on the data voltages during the frame.

The display panel 100 may display a brightness corresponding to medium grayscales between the 126 grayscale and the 127 grayscale, using the high grayscale and the low grayscale of the 126 grayscale and using the high grayscale and the low grayscale of the 127 grayscale.

For example, the grayscale correcting part 211 may receive a first display data DD1_126_127 having a first medium grayscale between the 126 grayscale and the 127 grayscale during a frame. The grayscale correcting part 211 may map the first medium grayscale between the 126 grayscale and the 127 grayscale to the look-up table LU provided from the memory 213 to read the first data D_144 which is a high grayscale having a 144 grayscale during the first section of the frame. The grayscale correcting part 211 may map the first medium grayscale between the 126 grayscale and the 127 grayscale to the look-up table LU provided from the memory 213 to read the second data D_109 which is a low grayscale having a 109 grayscale during the second section of the frame.

Thus, the data driver 240 provides data voltages generated based on the reference gamma voltages GV and each of the first data D_144 having the 144 grayscale and the second data D_109 having the 109 grayscale to the display panel 100. Accordingly, the display panel 100 may display a brightness corresponding to the first medium grayscale between the 126 grayscale and the 127 grayscale based on the data voltages during the frame.

The grayscale correcting part 211 may generate a second medium grayscale between the 126 grayscale and the 127 grayscale that is different from the first medium grayscale.

In another example, the grayscale correcting part 211 receives a second display data DD2_126_127 having the second medium grayscale between the 126 grayscale and the 127 grayscale that is different from the first medium grayscale during a frame. The grayscale correcting part 211 may map the second display data DD2_126_127 to the look-up table LU provided from the memory 213 to read a first data D_145 which is a high grayscale having a 145 grayscale during the first section of the frame. The grayscale correcting part 211 may map the second display data DD2_126_127 to the look-up table LU provided from the memory 213 to read a second data D_108 which is a low grayscale having a 108 grayscale during the second section of the frame.

Thus, the data driver 240 provides data voltages generated based on the reference gamma voltages GV and each of the first data D_145 having the 145 grayscale and the second data D_108 having the 108 grayscale. Accordingly, the display panel 100 may display a brightness corresponding to the second medium grayscale between the 126 grayscale and the 127 grayscale based on the data voltages during the frame.

Thus, according to an exemplary embodiment, the data driver 240 may generate more than 256 grayscales.

According to an exemplary embodiment of the invention, even when the display panel 100 displays a brightness according to the same display data DD during each of at least two consecutive frames, the first fluid 131 may be prevented from back-flowing due to the high grayscale and the low grayscale being different from the display grayscale of each of the frames.

Thus, at least one embodiment of the invention enables the brightness of the display panel 100 to be constantly maintained without using a reset voltage having a black grayscale and enables the display panel to be driven using a high frequency.

Figure 8:
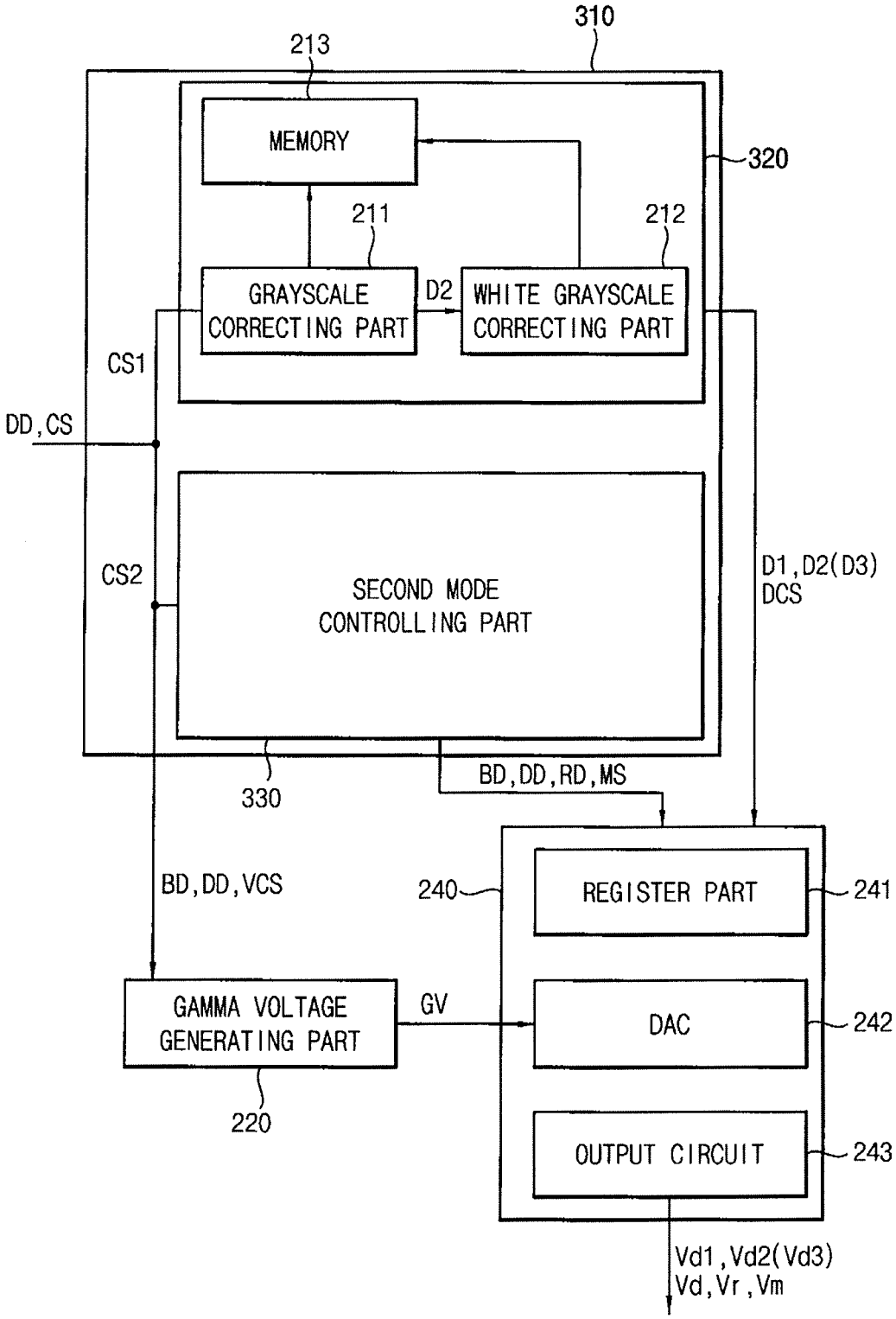
FIG. 8 is a block diagram illustrating a timing control part, a gamma voltage generating part and a source driver of an electro-wetting display apparatus according to an exemplary embodiment of the present invention.

FIG. 8 is a block diagram illustrating a timing controlling part 310, a gamma voltage generating part 220 and a data driver 240 (e.g., a source driver) of an electro-wetting display apparatus according to an exemplary embodiment of the present invention.

An electro-wetting display apparatus according to an exemplary embodiment described below is substantially the same as the electro-wetting display apparatus of FIG. 1 except for the timing controlling part, and thus the same reference numerals will be used to refer to the same or like parts.

Referring to FIG. 8, a driving part of an electro-wetting display apparatus includes a timing controlling part 310, a gamma voltage generating part 220, a gate driver 230 and a data driver 240.

The timing controlling part 310 receives a display data DD and a control signal CS from an external source. The timing controlling part 310 converts the display data DD according to a specification of the data driver 240, and generates a gamma control signal VCS, a gate control signal GCS and a data control signal DCS provided to the gamma voltage generating part 220, the gate driver 230 and the data driver 240, respectively.

The timing controlling part 310 includes a first mode controlling part 320 and a second mode controlling part 330.

The control signal CS includes a first control signal CS1 used in a high frequency driving state and a second control signal CS2 used in a low frequency driving state. When the timing controlling part 310 receives the first control signal CS1, the timing controlling part 310 operates with a high frequency mode by using the first mode controlling part 320, and when the timing controlling part 310 receives the second control signal CS2, the timing controlling part 310 operates with a low frequency mode by using the second mode controlling part 330.

The first control signal CS1 is provided to the timing controlling part 310 when the EWD is driven with a high frequency (e.g., to display a video), and the second control signal CS2 is provided to the timing controlling part 310 when the EWD is driven with a low frequency (e.g., to display an e-book). In an embodiment where the EWD is driven with the high frequency, the frame frequency is substantially the same as or greater than about 60 Hz. In an embodiment where the EWD is driven with the low frequency, the frame frequency is less than about 60 Hz. However, the boundary that distinguishes a frequency from being one of the low and high frequency is not limited to 60 Hz. For example, in alternate embodiments, frequencies higher than 60 Hz are frequencies of the low frequency (e.g., 61-80 Hz, etc.).

The first mode controlling part 320 includes a grayscale correcting part 211, a white grayscale correcting part 212 and a memory 213. The first mode controlling part 320 is substantially the same as the timing controlling part 210 of FIG. 1.

The second mode controlling part 330 provides the display data DD to the gamma voltage generating part 220 and the data driver 240 during a first time period of the frame. The second mode controlling part 330 generates a black data BD of a black grayscale and provides the black data BD to the gamma voltage generating part 220 and the data driver 240 during a second time period of the frame.

The second mode controlling part 330 provides a maintain signal MS to the data driver 240 during a third period of the frame that is longer than each of the first and the second periods and between the first period and the second period. The maintain signal MS constantly maintains a data voltage Vd according to the display data DD.

The interval of the first period may be substantially the same as the second time period to uniformly display a brightness of an upper side image of the display panel 100 and brightness of a lower side image of the display panel 100. Further, the second time period displaying the black grayscale may be set to a relatively short interval to improve the brightness of the entire display panel 100. For example, the second time period may be about 0.7 ms to about 3 ms.

The data driver 240 generates a data voltage Vd based on the display data DD and reference gamma voltages GV and provides the data voltage Vd to the display panel 100 during the first time period of the frame. The data driver 240 generates a reset voltage Vr based on the black data BD and the reference gamma voltages GV and provides the reset voltage Vr to the display panel 100 during the second time period of the frame.

The data driver 240 maintains the data voltage Vd based on the maintain signal MS during the third time period of the frame.

The display panel 100 displays a varying brightness according to the data voltage Vd during the first and third time periods of the frame, and displays a black brightness according to the reset voltage Vr during the second time period of the frame.

Thus, even when the display panel 100 displays the same brightness according to the display data DD during each of at least two consecutive frames, the first fluid 131 may be prevented from back-flowing by the reset voltage Vr, so that the brightness of the entire display panel 100 may be constantly maintained.

Figure 9:
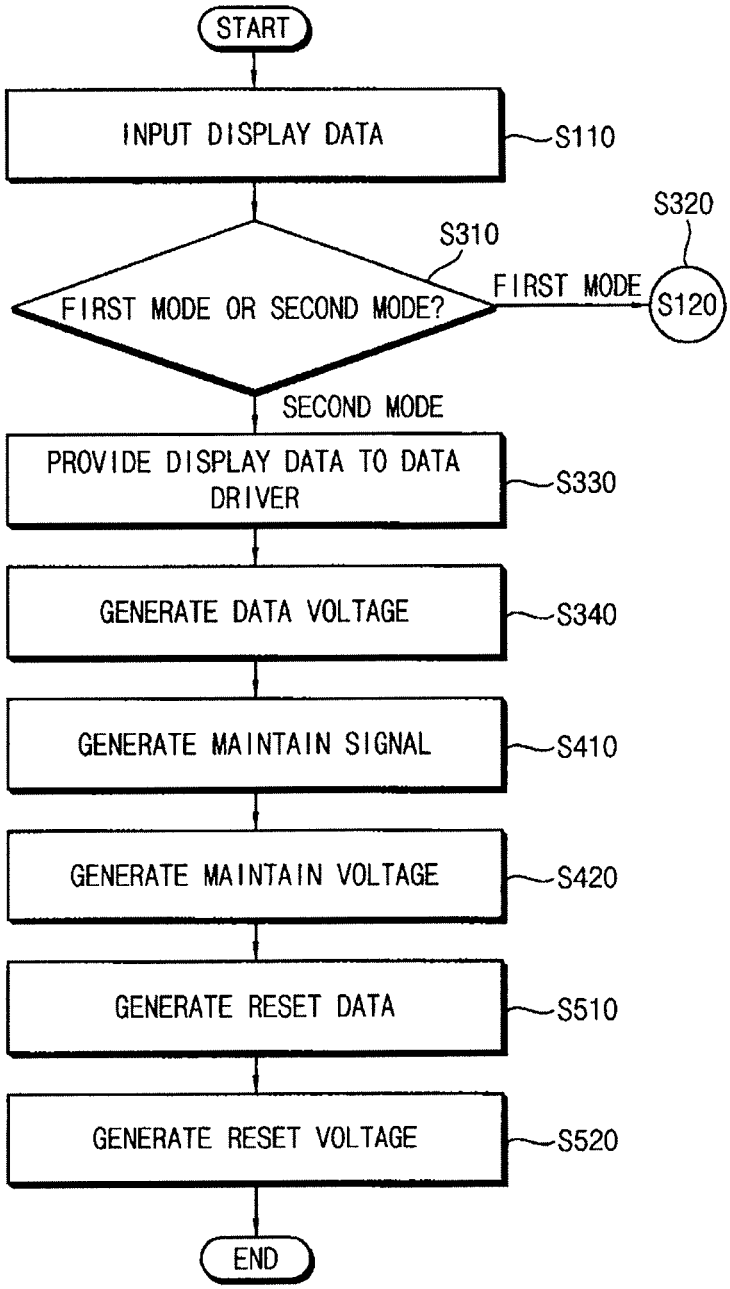
FIG. 9 is a flow chart illustrating a method of driving the electro-wetting display panel of FIG. 8 according to an exemplary embodiment of the present invention.
Figure 10:
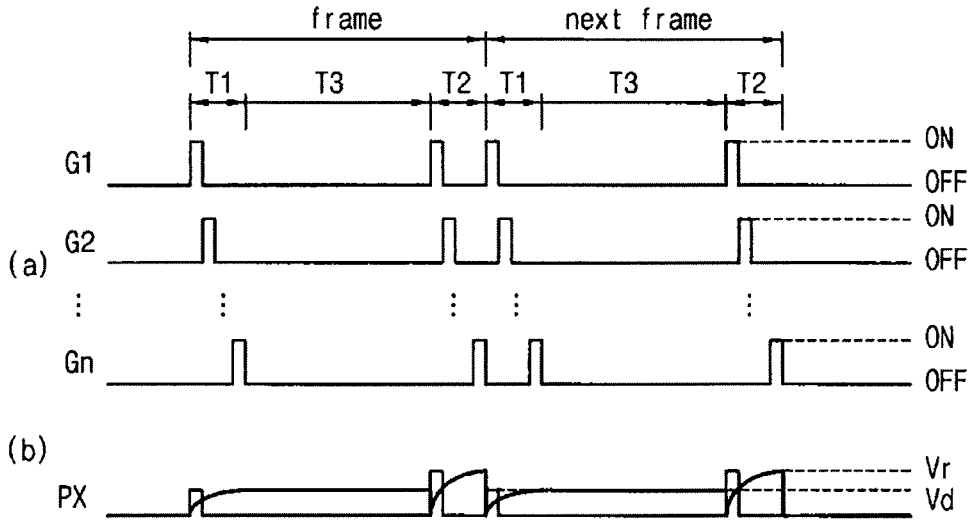
FIG. 10 includes timing diagrams illustrating exemplary electrical signals according to a second mode controlling part of FIG. 8.

FIG. 9 is a flow chart illustrating a method of driving the electro-wetting display panel of FIG. 8 according to an exemplary embodiment of the invention. FIG. 10 includes timing diagrams illustrating exemplary electrical signals according to a second mode controlling part of FIG. 8.

Referring to FIG. 9 and FIG. 10, the timing controlling part 210 receives display data DD and a controlling signal CS from an external source (step S110). The timing controlling part 310 selects one of a first mode and a second mode based on the control signal CS (step S310). The timing controlling part 310 may also generate a gamma control signal VCS, a gate control signal GCS and a data control signal DCS based on the control signal CS.

When the first mode is selected based on the first control signal CS1 of the control signal CS, the display data DD is provided to the first mode controlling part 320, and the first mode controlling part 320 is substantially same as the timing controlling part 210 of FIG. 1 (step S320).

When the second mode is selected based on the second control signal CS2 of the control signal CS, the display data DD is provided to the second mode controlling part 330, and the second mode controlling part 330 provides the display data DD and the data control signal DCS to the data driver 240 (step S330). The second controlling part 330 may provide the display data DD and the data control signal DCS during a first time period T1 of a frame, provide the gamma control signal VCS to the gamma voltage generating part 220, and provide the gate control signal GCS to the gate driver 230.

The gate driver 230 sequentially provides a gate-on signal ON based on the gate control signal GCS to the first gate line G1 to the n-th gate line Gn during the first time period T1 of the frame. The data driver 240 generates the data voltage Vd using the display data DD and the reference gamma voltages GV generated from the gamma voltage generating part 220 based on the data control signal DCS (step S340). The data driver 240 may then provide the data voltage Vd to the display panel 100 during the first time period T1 of the frame.

The second mode controlling part 330 generates the maintain signal MS for constantly maintaining the data voltage Vd (step S410). The second mode controlling part 330 may then provide the maintain signal MS to the data driver 240 during the third time period T3 of the frame of the display data DD. The data driver 240 provides a maintain voltage Vm based on the maintain signal MS to the display panel 100 (step S420).

Referring to FIG. 10 and reference numeral (a), the first gate line G1 to the n-th gate line Gn are sequentially activated (e.g., turned on) according to the gate-on signal ON during the first time period T1 of the frame. Referring to FIG. 10 and reference numeral (b), the data voltage Vd is provided to a pixel PX electrically connected to the first gate line G1 during the first time period T1 of the frame, and the pixel PX is charged with the data voltage Vd1 during the first and second time periods T1 and T2 of the frame.

The second mode controlling part 330 generates reset data RD (step S510). The second mode controlling part 330 may provide the reset data RD to the data driver 240 and provide the gamma control signal VCS to the gamma voltage generating part 220 during the second time period T2 of the frame. For example, the reset data RD may have a black grayscale.

The gate driver 230 sequentially provides the gate-on signal ON based on the gate control signal GCS to the first gate line G1 to the n-th gate line Gn during the second time period T2 of the frame, and the data driver 240 generates the reset voltage Vr based on the reset data RD and the reference gamma voltages GV (step S520). The data driver 240 may provide the reset voltage Vr to the display panel 100 during the second time period T2 of the frame.

Referring to FIG. 10 and reference numeral (a), the first gate line G1 to the n-th gate line Gn are sequentially activated (e.g., turned on) according to the gate-on signal ON during the second time period T2 of the frame. Referring to FIG. 10 and reference numeral (b), the reset voltage Vr is provided to the pixel electrically connected to the first gate line G1 during the second time period T2 of the frame, and the pixel PX is charged with the reset voltage Vr during the second time period T2 of the frame. The interval of the second time period T2 may be substantially the same as the first time period T1.

Thus, when the timing controlling part 310 receives the first control signal CS1 to drive the display data DD at a high frequency, the timing controlling part 310 provides the first and second data voltages Vd1 and Vd2 different from each other or the first and third data voltages Vd1 and Vd2 different from each other to the display panel 100 during the frame, so that an image may be displayed without reducing the brightness since the reset voltage Vr is not used.

Alternatively, when the timing controlling part 310 receives the second control signal CS2 to drive the display data DD at a low frequency, the timing controlling part 310 provides the data voltage Vd, the maintain voltage Vm and the reset voltage Vr to the display panel 100 during the frame, so that an image may be displayed without reducing the brightness.

According to an exemplary embodiment, when the frame is driven at the high frequency, the display data DD is driven by the first mode controlling part 320, and when the frame is driven at the low frequency, the display data DD is driven by the second mode controlling part 330, so that the first fluid 131 may be prevented from back-flowing.

According at least one embodiment of the present invention, even when the same display data is displayed during at least two consecutive frames, a first fluid of the EWC may be prevented from back-flowing by a low grayscale of the display data provided during a frame and by a high grayscale of the display data provided during a next frame. Thus, a brightness of a display panel may be prevented from being reduced.

Further, according to at least one embodiment of the present invention, an electro-wetting display apparatus is driven with a high frequency by a first mode controlling part or is driven with a low frequency by a second mode controlling part to reduce power consumption and prevent excessive amounts of heat from being generated.

Although exemplary embodiments of the present invention have been described above, those skilled in the art will readily appreciate that many modifications are possible in the exemplary embodiments without materially departing from the present invention. Therefore, it is to be understood that the foregoing is illustrative of the present invention and is not to be construed as limited to the specific exemplary embodiments disclosed, and that modifications to the disclosed exemplary embodiments, as well as other exemplary embodiments, are intended to be included within the scope of the disclosure.

What is claimed is:

1. A method of driving an electro-wetting display panel comprises:

applying a first data voltage to a pixel part of the display panel during a first section of a frame; and applying a second data voltage different from the first data voltage to the same pixel part during a second section of the frame, wherein the first data voltage is converted from display data based on a first gamma curve, wherein the second data voltage is converted from the same display data based on a second gamma curve, and wherein light transmittance through the pixel part is changed based on movement of a fluid within the pixel part.

2. The method of claim 1, wherein applying the first data voltage during the first section of the frame comprises:

mapping the display data to a first look-up table based on the first gamma curve, to read first data having a first grayscale; and generating the first data voltage using the first data, wherein applying the second data voltage during the second section of the frame comprises:

mapping the display data to a second look-up table based on the second gamma curve, to read second data having a second grayscale; and generating the second data voltage using the second data.

3. The method of claim 2, wherein the first grayscale is higher than the second grayscale.

4. The method of claim 3, further comprising:

generating a third data having a third grayscale lower than a threshold value, when the second grayscale is higher than the threshold value during each of at least two consecutive frames.

5. The method of claim 4, wherein the threshold value is a minimum of a white grayscale and medium grayscales adjacent the white grayscale.

6. A method of driving an electro-wetting display panel, the method comprising:

selecting a first mode from one of two available modes, wherein each mode corresponds to a driving mode of display data; and applying a first data voltage to a pixel part of the display panel during a first section of a current frame and a second data voltage different from the first data voltage to the pixel part during a second section of the current frame, wherein the first data voltage is converted from the display data based on a first gamma curve and the second data voltage is converted from the display data based on a second gamma curve, and wherein light transmittance through the pixel part is changed based on movement of a fluid within the pixel part.

7. The method of claim 6, further comprising:

selecting the second mode;

applying a third data voltage to the pixel part during a first time period of a subsequent frame;

maintaining a level of the applied third data voltage during a second time period of the subsequent frame; and applying a reset voltage to the pixel part during a third time period of the subsequent frame, wherein the third data voltage is converted from the display data of the display panel, and the reset voltage is converted from reset data.

8. The method of claim 7, wherein the first mode is driven at a driving frequency substantially the same as or greater than about 60 Hz and the second mode is driven at a driving frequency less than about 60 Hz.

9. An electro-wetting display apparatus comprising:

an electro-wetting display panel configured to display an image, and comprising a first substrate including a plurality of pixel electrodes, a second substrate including a common electrode facing the pixel electrodes and a fluidic layer disposed between the first substrate and the second substrate, wherein the fluidic layer adjusts light transmittance; and a driving part configured to provide a first data voltage to the electro-wetting display panel during a first section of a frame and a second data voltage to the electro-wetting display panel during a second section of the frame, wherein the driving part is configured to convert display data of the image to the first data voltage based on a first gamma curve, convert the same display data to the second data voltage based on a second gamma curve, and wherein the second data voltage is different from the first data voltage.

10. The electro-wetting display apparatus of claim 9, wherein the first substrate comprises a plurality of notch electrodes respectively corresponding to the pixel electrodes.

11. The electro-wetting display apparatus of claim 10, wherein the fluidic layer comprises:

a first fluid corresponding to the pixel electrode and the notch electrode, the first fluid being hydrophobic; and a second fluid corresponding to the common electrode, the second fluid being hydrophilic, wherein the first fluid moves toward the notch electrode due to a voltage difference between the pixel electrode and the common electrode.

12. The electro-wetting display apparatus of claim 9, wherein the driving part comprises:

a timing controlling part comprising a grayscale correcting part that is configured to map the display data to a first look-up table based on the first gamma curve to read first data having a first grayscale during the first section and map the display data to a second look-up table based on the second gamma curve to read second data having a second grayscale during the second section;

a gamma voltage generating part configured to generate a reference gamma voltage according to the display data; and a data driver configured to generate the first data voltage using the first data and the reference gamma voltage, and generate the second data voltage using the second data and the reference gamma voltage.

13. The electro-wetting display apparatus of claim 12, wherein the first grayscale is higher than the second grayscale.

14. The electro-wetting display apparatus of claim 13, wherein the timing controlling part further comprises a white grayscale correcting part configured to generate third data having a third grayscale lower than a threshold value during each of at least two consecutive frames, when the first grayscale is higher than the threshold.

15. The electro-wetting display apparatus of claim 14, wherein the threshold value is a minimum of a white grayscale and medium grayscales adjacent the white grayscale.

16. An electro-wetting display apparatus comprising:

an electro-wetting display panel configured to display an image, and comprising a first substrate including a plurality of pixel electrodes, a second substrate including a common electrode facing the pixel electrodes and a fluidic layer disposed between the first substrate and the second substrate, wherein the fluidic layer adjusts light transmittance; and a driving part configured to drive display data of the image in one of a first mode and a second mode, wherein the driving part, in the first mode, is configured to provide a first data voltage converted from the display data based on a first gamma curve and a second data voltage converted from the display data based on a second gamma curve to the electro-wetting display panel during a current frame, wherein the second data voltage is different from the first data voltage, and wherein the driving part, in the second mode, is configured to provide a third data voltage converted from the display data and a reset voltage converted from a reset data to the electro-wetting display panel during a subsequent frame.

17. The electro-wetting display apparatus of claim 16, wherein the driving part comprises a timing controlling part configured to drive the display data in the first mode based on a first control signal and the second mode based on a second control signal, wherein the timing controlling part comprises:

a first mode controlling part configured to map the display data to a first look-up table based on the first gamma curve to read first data having a first grayscale during a first section of the frame, and map the display data to a second look-up table based on the second gamma curve to read second data having a second grayscale during a second section of the frame, in a first mode; and a second mode controlling part configured to output the display data during a first time period of the frame, provide a maintain signal to constantly maintain a third data voltage according to the display data during a second time of the frame, and provide a reset data during a third time period of the frame, in the second mode.

18. The electro-wetting display apparatus of claim 17, wherein the driving part further comprises:

a gamma voltage generating part configured to generate a reference gamma voltage according to the display data; and a data driver configured to generate the first data voltage using the first data and the reference gamma voltage, the second data voltage using the second data and the reference gamma voltage, the third data voltage using the display data and the reference gamma voltage, and a reset voltage using reset data and the reference gamma voltage.

19. The electro-wetting display apparatus of claim 17, wherein the first mode is driven at substantially the same or greater than about 60 Hz and the second mode is driven at less than about 60 Hz.

20. The electro-wetting display apparatus of claim 17, wherein the reset data has a black grayscale.

21. A method of driving an electro-wetting display panel comprises:

generating a first grayscale that is higher than display data for the display panel;

generating a second grayscale that is lower than the display data;

applying a first data voltage based on the first gray scale to a pixel part of the display panel during a first section of a frame; and applying a second data voltage based on the second grayscale to the same pixel part during a second section of the frame, wherein the pixel part includes a fluid whose movement is adjusted by the applied voltages to change transmittance of light through the pixel part.

22. The method of claim 21, wherein the second grayscale is lower than a half-brightness grayscale of the display panel.

* * * * *